US008628606B2

(12) United States Patent
Hodgson et al.

(10) Patent No.: US 8,628,606 B2
(45) Date of Patent: Jan. 14, 2014

(54) EXHAUST GAS TREATMENT DEVICE HAVING TWO HONEYCOMB BODIES FOR GENERATING AN ELECTRIC POTENTIAL, METHOD FOR TREATING EXHAUST GAS AND MOTOR VEHICLE HAVING THE DEVICE

(75) Inventors: Jan Hodgson, Troisdorf (DE); Christian Vorsmann, Köln (DE)

(73) Assignee: EMITEC Gesellschaft fuer Emissionstechnologie mbH, Lohmar (DE)

( * ) Notice: Subject to any disclaimer, the term of this patent is extended or adjusted under 35 U.S.C. 154(b) by 0 days.

(21) Appl. No.: 13/419,636

(22) Filed: Mar. 14, 2012

(65) Prior Publication Data

US 2012/0186447 A1 Jul. 26, 2012

Related U.S. Application Data

(63) Continuation of application No. PCT/EP2010/062464, filed on Aug. 26, 2010.

(30) Foreign Application Priority Data

Sep. 14, 2009 (DE) ..... 10 2009 041 092

(51) Int. Cl.
*B03C 3/41* (2006.01)

(52) U.S. Cl.
USPC ..... 96/55; 55/385.3; 60/275; 95/69; 95/70; 96/57; 96/68; 96/97

(58) Field of Classification Search
USPC ..... 96/55, 57, 97, 68; 95/69, 70; 55/385.3, 55/DIG. 30, 523, 524; 60/275, 302, 311; 422/171, 180, 186.04, 222, 633
See application file for complete search history.

(56) References Cited

U.S. PATENT DOCUMENTS 4,979,364 A * 12/1990 Fleck ..... 60/274
5,271,906 A * 12/1993 Yuuki et al. ..... 422/177

(Continued)

FOREIGN PATENT DOCUMENTS

DE 4434673 A1 4/1996
DE 102008035561 A1 2/2010

(Continued)

OTHER PUBLICATIONS

International Search Report of PCT/EP2010/062464, dated Dec. 13, 2010.

*Primary Examiner* — Richard L Chiesa
(74) *Attorney, Agent, or Firm* — Laurence A. Greenberg; Werner H. Stemer; Ralph E. Locher

(57) ABSTRACT

An exhaust gas treatment device includes at least a first at least partially electrically conductive honeycomb body having a first front side and a first rear side, a second at least partially electrically conductive honeycomb body having a second front side and a second rear side, an intermediate space between the first honeycomb body and the second honeycomb body, a power supply for the formation of an electric potential between the first honeycomb body and the second honeycomb body, and a multiplicity of electrodes fastened to the first honeycomb body, extending beyond the first rear side over a first length into the intermediate space and positioned at a first distance from the second front side of the second honeycomb body. A method for treating motor vehicle exhaust gas containing particles and a motor vehicle are also provided.

12 Claims, 3 Drawing Sheets

(56) References Cited

U.S. PATENT DOCUMENTS

| | | | | |
|---|---|---|---|---|
| 5,465,573 | A * | 11/1995 | Abe et al. | 60/274 |
| 5,474,600 | A * | 12/1995 | Volodina et al. | 96/57 |
| 5,733,360 | A * | 3/1998 | Feldman et al. | 95/78 |
| 5,950,424 | A * | 9/1999 | Nojima | 60/275 |
| 6,112,520 | A | 9/2000 | Kaiho et al. | |
| 6,723,146 | B2 * | 4/2004 | Ninomiya et al. | 55/344 |
| 6,866,828 | B2 * | 3/2005 | Segawa et al. | 422/186.04 |
| 6,938,409 | B2 * | 9/2005 | Birckigt et al. | 60/275 |
| 7,074,370 | B2 * | 7/2006 | Segal et al. | 422/186.04 |
| 7,316,106 | B2 * | 1/2008 | Son | 60/295 |
| 7,331,170 | B2 | 2/2008 | Shimoda | |
| 7,776,140 | B2 * | 8/2010 | Fleck | 96/69 |
| 7,863,540 | B2 | 1/2011 | Masuda et al. | |
| 2001/0043890 | A1 * | 11/2001 | Son | 422/174 |
| 2004/0231321 | A1 * | 11/2004 | Yamato et al. | 60/275 |
| 2005/0081512 | A1 * | 4/2005 | Yahagi | 60/274 |
| 2007/0028603 | A1 | 2/2007 | Igarashi | |
| 2008/0170971 | A1 * | 7/2008 | Bergeron et al. | 422/171 |
| 2009/0007544 | A1 * | 1/2009 | Bruck | 60/275 |
| 2009/0038300 | A1 | 2/2009 | Naito et al. | |
| 2011/0158870 | A1 | 6/2011 | Hodgson et al. | |

FOREIGN PATENT DOCUMENTS

| | | | |
|---|---|---|---|
| EP | 1632654 | A1 | 3/2006 |
| EP | 1669563 | A1 | 6/2006 |
| EP | 1840938 | A1 | 10/2007 |
| JP | 63-268911 | A * | 11/1988 |
| JP | 2005232970 | A | 9/2005 |
| JP | 2007009839 | A | 1/2007 |

* cited by examiner

EXHAUST GAS TREATMENT DEVICE HAVING TWO HONEYCOMB BODIES FOR GENERATING AN ELECTRIC POTENTIAL, METHOD FOR TREATING EXHAUST GAS AND MOTOR VEHICLE HAVING THE DEVICE

CROSS-REFERENCE TO RELATED APPLICATION

This is a continuation, under 35 U.S.C. §120, of co-pending International Application No. PCT/EP2010/062464, filed Aug. 26, 2010, which designated the United States; this application also claims the priority, under 35 U.S.C. §119, of German Patent Application DE 10 2009 041 092.9, filed Sep. 14, 2009; the prior applications are herewith incorporated by reference in their entirety.

BACKGROUND OF THE INVENTION

Field of the Invention

The invention relates to an exhaust gas treatment device for generating an electric potential and/or an electric field and/or plasma. The intended effect of the plasma is to at least agglomerate or electrically charge soot particles in a flow of exhaust gas, thus promoting deposition of the particles in a particle filter. Such an exhaust gas treatment device can be employed in a motor vehicle, for example. The invention also relates to a method for treating exhaust gas and a motor vehicle having the device.

In the case of motor vehicles with mobile internal combustion engines and, in particular, in the case of motor vehicles with a diesel drive, the exhaust gas from the internal combustion engine generally contains quantities of soot particles, and they must be discharged into the environment. That is stipulated by corresponding exhaust gas regulations, which specify limits for the number and mass of soot particles per unit of exhaust gas weight or exhaust gas volume and, in some cases, also for an entire motor vehicle. Soot particles are, in particular, unburned carbon and hydrocarbon compounds in the exhaust gas.

The fact that the provision of an electric field and/or a plasma causes agglomeration of small soot particles into larger soot particles and/or causes an electric charge in soot particles, is known. Electrically charged soot particles and/or relatively large soot particles are generally very easy to remove in a filter system. Due to their relatively high inertia, soot particle agglomerates are transported more sluggishly in a flow of exhaust gas and thus settle more easily at points where a flow of exhaust gas is deflected. Due to their charge, electrically charged soot particles are attracted to surfaces, accumulating on those surfaces and losing their charge. That, too, facilitates the removal of soot particles from the stream of exhaust gas during the operation of motor vehicles.

The systems already proposed for generating and/or (temporarily) maintaining an electric field and/or plasma are generally very complex technically and/or inadequate in terms of efficiency. It has likewise been possible to identify problems with the formation of a uniform electric field and/or an electric field matched selectively to the flow of exhaust gas. At any rate, none of the existing systems appears to be ready for series production as part of motor vehicle construction.

SUMMARY OF THE INVENTION

It is accordingly an object of the invention to provide an exhaust gas treatment device having two honeycomb bodies for generating an electric potential, a method for treating exhaust gas and a motor vehicle having the device, which overcome the hereinafore-mentioned disadvantages and at least partially solve the highlighted problems of the heretofore-known devices, methods and vehicles of this general type. In particular, it is intended to disclose a device for generating an electric field for a mobile exhaust gas treatment system which is an improvement over the prior art.

With the foregoing and other objects in view there is provided, in accordance with the invention, an exhaust gas treatment device, comprising a first at least partially electrically conductive honeycomb body having a first front side and a first rear side, a second at least partially electrically conductive honeycomb body having a second front side and a second rear side, the first honeycomb body and the second honeycomb body defining an intermediate space therebetween, a power supply configured to form an electric potential between the first honeycomb body and the second honeycomb body, and a multiplicity of electrodes fastened to the first honeycomb body, extending beyond the first rear side by a first length into the intermediate space and positioned at a first distance from the second front side of the second honeycomb body.

In an exhaust gas treatment device of this kind, an electric field can be generated between the electrodes (first pole) on the first honeycomb body and the second honeycomb body (second pole) with the aid of the power source. In this case, the electrodes act substantially as point-like or punctiform electrodes, as compared with a flat electrode formed by the second front side of the second honeycomb body. A configuration of this kind is particularly suitable for generating an electric field and/or for the formation of a plasma because, as a rule, electric charges emerge at the electrodes acting in a point-like or punctiform manner, due to the high concentration of the electric field in this area. The large number of electrodes significantly improves the formation of a selectively specified field in the intermediate space.

The first honeycomb body and/or the second honeycomb body preferably have metallic components which are electrically conductive. In addition to extruded honeycomb bodies, which are at least partially constructed by using such materials, honeycomb bodies which are constructed with at least one at least partially structured metal foil (if appropriate made of stacks including alternate smooth and corrugated metal foils) are used, in particular. The first honeycomb body and/or the second honeycomb body preferably have channels (running in a straight line and/or parallel) extending from the front side to the rear side. The channels are formed by perforated channel walls, if appropriate. The first honeycomb body and/or the second honeycomb body preferably have a channel density of between 50 cpsi and 1000 cpsi, preferably about 600 cpsi [channels per square inch]. This provides sufficient attachment points for the electrodes over the cross section, thus making it possible to set the two dimensional or three dimensional form of the electric field very precisely. At least some of the electrodes, preferably all of the electrodes, are constructed as (rectilinear) metallic pins with a diameter of between 0.5 mm and 3 mm, preferably 1 mm to 2 mm [millimeters].

The first honeycomb body is therefore a significant component of this exhaust gas treatment device, being decisive for the provision of the entire configuration for the formation of the electric field. This can accordingly be described independently of the overall configuration as follows: an at least partially electrically conductive honeycomb body having a first front side and a first rear side, wherein a multiplicity of electrodes, which are fastened to the first honeycomb body, extend over a first length beyond the first rear side.

The electrodes are preferably connected in an electrically conductive manner, e.g. brazed or welded, to the honeycomb body. The number of electrodes is preferably at least 10 or even at least 30.

With regard to the provision of the electrodes, it is preferred if the first length with which the electrodes project beyond the first rear side of the first honeycomb body is at least 2 mm [millimeters], preferably at least 3 mm. The first length should furthermore be at most 20 mm, preferably at most 15 mm, and particularly preferably at most 10 mm. It is preferred if all the electrodes meet the above requirements, although different first lengths can be provided, if appropriate, for at least some of the electrodes.

On one hand, this configuration of the first length (or of the protrusion) of the electrodes ensures that the electric field is formed only between the electrodes and the second honeycomb body and not between the second honeycomb body and the first honeycomb body. At the same time, sufficient compactness and mechanical stability of the exhaust gas treatment device is ensured. The exhaust gas treatment device according to the invention has the advantage that the position of the electrodes can be set in a particularly precise way and hence that a particularly accurately defined electric field and/or plasma can be operated in the intermediate space. The first length (or protrusion) of the electrodes can thus be adapted selectively to the flow of exhaust gas to be treated and/or to the spatial conditions, depending on the power supply.

As an alternative or supplement to the fastening of the multiplicity of electrodes and the first honeycomb body, it is proposed that a multiplicity of electrodes, which are fastened to the second honeycomb body, extend beyond the second front side with a second length into the intermediate space and are positioned at a second distance from the first rear side of the first honeycomb body. The magnitude of the second length and/or the magnitude of the second distance can differ from or be equal to the magnitude of the first length and the magnitude of the first distance, respectively.

In accordance with another advantageous feature of the exhaust gas treatment device of the invention, the first length of at least one electrode is made different from the first length of the other electrodes. In this way, a concentrated or expanded electric field toward the second front side of the second honeycomb body can be generated in the region of the at least one longer or shorter electrodes. This can be appropriate in the central region of the honeycomb bodies, for example, where there is an increased flow of exhaust gas and hence also more particles have to be deposited.

In addition to the first length, the electrodes can (as an alternative or supplementary measure) differ from one another at least with regard to one of the following properties:

- material,
- orientation (to the direction of flow, to the front side and/or the rear side, etc.),
- distance from the adjacent electrode,
- attachment to the first honeycomb body (contact area, contact length, connecting device, etc.),
- power supply (power sources, electric connecting conductors, etc.),
- shape (rod, multipoint, plate, etc.).

In accordance with a further advantageous feature of the exhaust gas treatment device of the invention, at least the first rear side of the first honeycomb body or at least the second front side of the second honeycomb body has a non-planar shape. Through the use of a configuration of this kind, the flow distribution over the cross section can be influenced by the honeycomb bodies. The channels in the honeycomb bodies can have different lengths through one honeycomb body having a non-planar shape, for example. In this way, the construction of the honeycomb body and the prevailing flow of exhaust gas can also be matched to the electric field that can be generated.

It is furthermore possible for the first rear side of the first honeycomb body and/or the second front side of the second honeycomb body to have a shape which deviates from a planar surface (in other words a surface which is flat or lies in one plane). These differences in shape (or differences in the length of the intermediate space over the cross section) can be compensated for by variation of the first length of the electrodes. As a result, it is thus nevertheless possible for the first distance between the electrodes and the second honeycomb body to be set so as to be equal at any point even though the first rear side of the first honeycomb body is disposed at different distances from the second front side of the second honeycomb body.

It is furthermore preferred if the at least one electrode has a tip which tapers conically. It is furthermore preferred if all of the electrodes have such a tip. A tip which tapers conically makes it possible to achieve a higher concentration in the electric field in the region of the tip, further promoting the formation of an electric field and/or plasma between the electrodes and the second honeycomb body. At the same time, the pins of which the electrodes are formed can have a certain thickness, which is greater than the cross section of the tip, thereby achieving a high mechanical stability of the electrodes and good fastening of the electrodes in the first honeycomb body.

It is moreover advantageous if the at least one electrode is offset toward the intermediate space. This means, in particular, that the diameter of the electrode changes abruptly at least once, in particular decreases in the direction of the intermediate space. In this way, reliable fastening to the first honeycomb body is ensured, even when there is wear on the electrode.

In accordance with an added advantageous feature of the exhaust gas treatment device of the invention, precisely with a view toward use in a motor vehicle, the first distance is between 5 mm and 100 mm. The range from 25 mm to 40 mm is very particularly preferred. It has been found that such first distances are particularly advantageous for the formation of an electric field and/or plasma.

In accordance with an additional feature of the invention, an insulator surrounding the intermediate space is provided. The first honeycomb body should generally be insulated electrically from the rest of the exhaust system and, in particular, also from a surrounding exhaust line to enable a voltage to be built up (only) between the electrodes and the second honeycomb body. An electric insulator surrounding the intermediate space is also advantageous for the purpose of ensuring that an electric field forms only between the electrodes and the second honeycomb body and not between the electrodes and the wall of the exhaust line. It is also possible to avoid an electric field between the wall and the electrodes if the distance from the electrodes to the wall is in each case greater than the distance from the electrodes to the second honeycomb body. In a particularly preferred embodiment, a ring of polymethyl methacrylate or a similar material is provided as an electric insulator between the two honeycomb bodies.

According to a development of the exhaust gas treatment device, the second honeycomb body is embodied as a ring. In particular, the second honeycomb body is disposed in a ring around the original central direction of flow of the exhaust gas, as a result of which the exhaust gas is at least partially deflected in order to flow through the second honeycomb body. The second honeycomb body can thus also be used, in particular, as an annular catalyst carrier body.

It is also possible to make the electric insulator, at least of one honeycomb body, from mica. Mica is, in particular, a clear transparent material (aluminosilicate) with a high dielectric resistance. Mica is resistant to a constant working temperature of at least 550° C. and has a melting point of about 1250° C. Moreover, mica is resistant to almost all media, e.g. alkalis, chemicals, gases, oils and acids. The mica insulator can, for example, be constructed as a supporting mat in such a way that it also simultaneously compensates for differences of expansion due to temperature differences between the first honeycomb body and/or the second honeycomb body, on one hand, and the exhaust line on the other. The electric insulator should have an electric strength with respect to electric voltages of at least 20 kV [20 kilovolts=20,000 volts], preferably of at least 30 kV [30 kilovolts=30,000 volts].

In accordance with yet another feature of the exhaust gas treatment device of the invention, the power supply is set up to generate an electric voltage of at most between 5 kV [5 kilovolts=5000 volts] and 30 kV [30 kilovolts=30,000 volts] between the first honeycomb body and the second honeycomb body. The power supply to the electrodes is generally accomplished (individually, jointly and/or in groups) through the electrically conductive first honeycomb body. What is being proposed herein is therefore, in particular, a high-voltage supply. At a distance of between 5 mm and 50 mm and a voltage of 5 kV [kilovolts], mean field strengths of above 1 million V/m [volts per meter] can be achieved in the intermediate space. In the region of the electrodes, there is an additional concentration of the electric field to significantly above this value, due to the point-like form of the electrodes. Such electric fields are particularly suitable for the formation of a plasma. The high field concentration in the region of the electrodes promotes the emergence of electrons from the electrodes.

It is furthermore proposed that the power supply be connected to at least the first honeycomb body or the second honeycomb body at least in sections through the use of a coaxial cable. A shield for the coaxial cable can thus serve as a positive conductor for connecting the power supply to the first honeycomb body or the second honeycomb body, and an internal conductor of the coaxial cable can serve as a negative conductor for connecting the power source to the second honeycomb body or the first honeycomb body. Irrespective of the coaxial cable, the degree of protection of the connection should also comply with protection class IP68, and should thus be protected in a dust-tight manner and against continuous submersion.

In accordance with yet another advantageous feature of the invention, the first honeycomb body has at least one at least partially structured metal foil, and the second honeycomb body has at least one filter material. A partially structured metal foil can also be provided in the second honeycomb body. As a rule, an at least partially structured metal foil is electrically conductive and can thus assure the power supply to the electrodes. The at least partially structured metal foil can be coiled, wound and/or stacked to form the honeycomb body. The filter material of the second honeycomb body allows effective deposition of the agglomerated and/or electrically charged soot particles in the second honeycomb body. Preferred candidates for consideration as a filter material in this case are a metallic woven fabric and/or nonwoven formed by a multiplicity of wire filaments (welded or brazed together). The second honeycomb body can then be embodied, in particular, in the manner of an open particle separator, in which the channels are in part delimited by a metal foil with deflections and openings, on one hand, and by the filter material, on the other hand, wherein the channels do not have any closure from the second front side to the second rear side but instead have a plurality of deflections or openings, through the use of which the exhaust gas together with the particles is directed toward the filter material (or into an adjacent channel).

With the objects of the invention in view, there is also provided a method for treating exhaust gas containing soot particles. The method comprises providing an exhaust gas treatment device according to the invention, and at least temporarily applying an electric field between the first honeycomb body and the second honeycomb body, causing at least some of the soot particles flowing through the exhaust gas treatment device to be at least ionized or agglomerated and deposited on the second honeycomb body.

A preferred option in this context is for the exhaust gas initially to pass through the first honeycomb body and, if appropriate, to be brought into contact with a first catalyst as it does so, then to flow through the intermediate space, in which the electric field is formed, as a result of which ionization and/or agglomeration of the soot particles is initiated there, and finally to impinge upon the second honeycomb body, where the soot particles are preferably deposited. The cleaned exhaust gas then leaves the exhaust gas treatment device after emerging from the second rear side.

It is furthermore preferred if the power supply is operated in such a way that a current between the first honeycomb body and the second honeycomb body is regulated to 0.005 mA [milliamperes] to 0.5 mA, preferably to 0.01 mA to 0.1 mA. During the operation of the exhaust gas treatment device, a current arises through charge transfer to the soot particles. Regulation of the current to the proposed range of values allows sufficient charging of the soot particles but also prevents the occurrence of sparking.

The method according to the invention is furthermore advantageous if the electric field is activated and deactivated at a repetition rate of between 2 and 30,000 Hz [1/second], preferably between 2 and 2000 Hz, and particularly preferably between 50 and 2000 Hz. Such a repetition rate allows particularly effective generation of an electric field, as a result of which soot particles are at least ionized or agglomerate.

The method is also advantageous if the repetition rate is controlled in accordance with the exhaust gas temperature. If the internal combustion engine is already delivering exhaust gas at a temperature suitable, for example, for catalytic conversion, the repetition rate and/or the magnitude of the potential difference can be reduced.

It is also preferred if the electric field is activated with a rising ramp. This means, for example, in particular during the operation of the power supply at a repetition rate, that the voltage or current is increased to the operating level in a time equal to no more than half the reciprocal of the repetition rate. It has been found that a higher final voltage can be achieved in this way, without the occurrence of sparking.

In accordance with another mode of the method of the invention, a first set of the electrodes is operated differently from a second set of the electrodes. Thus, for example, the electrodes can be operated with separate circuits, i.e. can be activated and deactivated with different voltages and/or operating times. The electric field can thus be regulated in accordance with the actual flow of exhaust gas through the use of predetermined, calculated and/or measured parameters.

In order to prevent the deposition of soot particles, it is also possible for an additional honeycomb body to be disposed upstream of the exhaust gas treatment device according to the invention. That honeycomb body evens out and/or even laminarizes a flow of exhaust gas flowing through to ensure that no flow vortices with dead zones—which promote deposition of soot particles—occur as it flows through the downstream exhaust gas treatment device according to the invention.

With the objects of the invention in view, there is concomitantly provided a motor vehicle, comprising an internal combustion engine and an exhaust gas treatment device according to the invention connected to the internal combustion engine for treating exhaust gases from the internal combustion engine.

The advantages and special embodiments described in connection with the exhaust gas treatment device according to the invention and the special methods of operation and advantages explained in connection with the method according to the invention can be applied to each other in an analogous and technologically appropriate manner within the scope of the invention.

Other features which are considered as characteristic for the invention are set forth in the appended claims, noting that the features presented individually in the claims can be combined in any technologically meaningful way and can be supplemented by explanatory material from the description, giving rise to additional variant embodiments of the invention.

Although the invention is illustrated and described herein as embodied in an exhaust gas treatment device having two honeycomb bodies for generating an electric potential, a method for treating exhaust gas and a motor vehicle having the device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
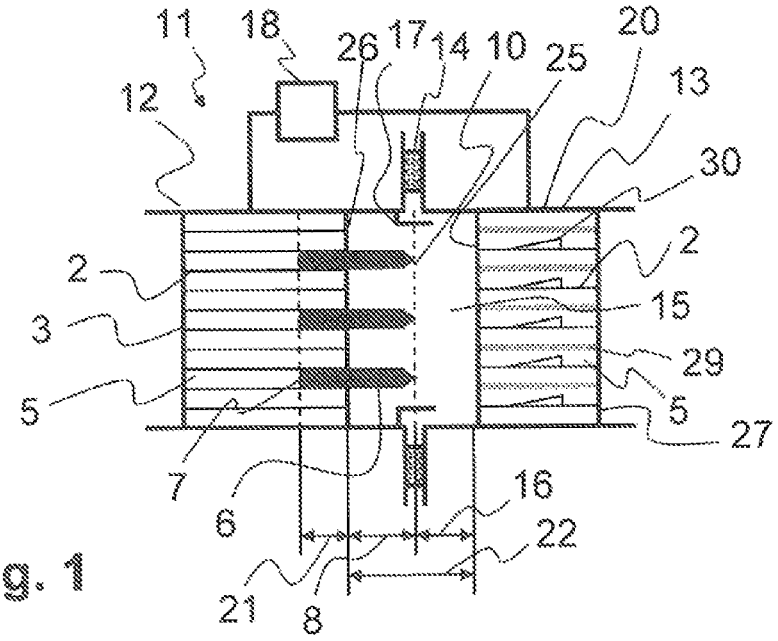
FIG. 1 is a diagrammatic, longitudinal-sectional view of a first embodiment of an exhaust gas treatment device according to the invention.
Figure 2:
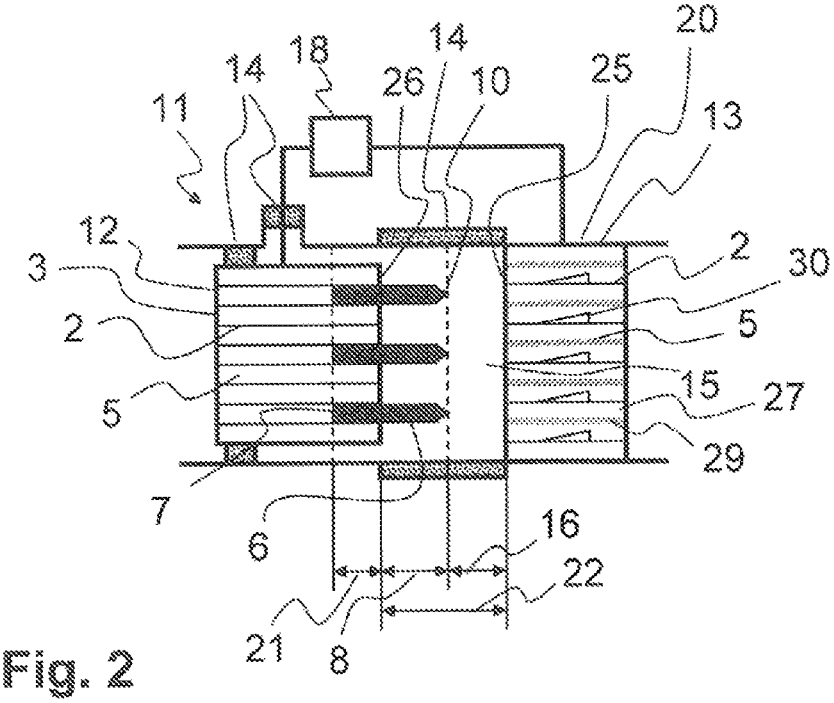
FIG. 2 is a longitudinal-sectional view of a second embodiment of an exhaust gas treatment device according to the invention.

Referring now to the figures of the drawings in detail and first, particularly, to FIGS. 1 and 2 thereof, there are seen exhaust gas treatment devices 11 according to the invention. The exhaust gas treatment devices 11 have a first honeycomb body 12 and a second honeycomb body 13. The first honeycomb body 12 has channels 5 extending from a first front side 3 to a first rear side 26. The second honeycomb body 13 likewise has channels 5 extending from a second front side 25 to a second rear side 27. Pin-shaped or rod-shaped electrodes 6 are provided on the first honeycomb body 12. The electrodes 6 protrude over a second length 21 into the channels 5 in the first honeycomb body 12. This length 21 is preferably (but not necessarily) dimensioned in such a way that the (ends 7 of the) electrodes do not project beyond the first front side 3. The second length 21 can be made different, at least for some of the electrodes 6, as a result of which different (electric) contacts are made, for example. The first honeycomb body 12 is preferably produced from smooth and structured metal foils 2. The electrodes 6 can be fastened to the metal foils 2 through the use of brazing and/or welding. The electrodes 6 preferably do not completely close the channels 5 into which they are inserted. In this case, the metal foils 2 serve at least partially as electric conductors, through which current is carried (separately or jointly) toward the electrodes.

In the variant embodiments shown in FIGS. 1 and 2, the second honeycomb body 13 is likewise constructed in part with structured metal foils 2 and, in this case, they have deflection structures 30. An embodiment in which a plurality of deflection structures 30 is disposed in each channel 5 is preferred. Moreover, the second honeycomb body 13 includes filter materials 29, preferably (catalytically coated) metallic nonwovens. Soot particles contained in the flow of exhaust gas can be deposited in the filter materials 29. Deposition is a result, in particular, of the fact that (even without alternate closures for the channels) a flow of exhaust gas flowing through the second honeycomb body 13 is repeatedly deflected in the direction of the filter materials 29 by the deflection structures 30. The deflection structures 30 only partially close the channels 5 in the second honeycomb body 13.

An intermediate space 15, in which an electric field and/or plasma can be generated during operation, is provided in each case between the first honeycomb body 12 and the second honeycomb body 13. The first rear side 26 of the first honeycomb body 12 and the second front side 25 of the second honeycomb body 13, lying opposite one another, are spaced apart by a second distance 22. The electrodes 6 project from the first honeycomb body 12 over a first length 8, as a result of which there is a first distance 16 between the electrodes 6 and the second front side 25 of the second honeycomb body. Moreover, the electrodes 6 have tips 10, which are preferably conical in order to achieve more intense concentration of an electric field at the tips 10 during operation.

The first honeycomb body 12 and the second honeycomb body 13 are insulated from one another by an electric insulator 14. Moreover, there is a power supply 18, through which an electric voltage can be generated between the first honeycomb body 12 (more specifically the numerous electrodes) and the second honeycomb body 13 (more specifically the second front side or face thereof).

There are various possible embodiments for enabling the first honeycomb body 12 and the second honeycomb body 13 to be insulated relative to one another. As FIG. 1 shows, the first honeycomb body 12 and the second honeycomb body 13 can be provided with the insulator 14, which electrically insulates the entire exhaust gas treatment device 11. If appropriate, similar insulators can then also be formed ahead of the first honeycomb body and/or after the second honeycomb body in order to electrically decouple the remainder of the exhaust system, if the first honeycomb body is supplied with electric energy through a housing, for example.

However, according to the embodiment of FIG. 2, the first honeycomb body 12 can also be isolated from the exhaust system through the use of the insulator 14. Power supply through the housing or an exhaust line 20 is thus accomplished through the use of an electrically insulated connection. The insulator 14 can be in the form of an encircling ring, for example, which can likewise be provided in order to delimit the electric field or the intermediate space 15, as indicated in FIG. 2. It is possible to prevent the generation of an electric field between the exhaust line 20 and the electrodes 6 through the use of an annular insulator 14 of this kind.

According to the embodiment of FIG. 1, it is also possible to provide a cover 17 for the insulator 14. The cover makes it possible to at least partially prevent exhaust gas and/or soot particles from flowing against the insulator 14. In this way, it is possible to prevent soot particles from being deposited in the region of the insulator 14 and forming a short circuit path.

An electric insulator 14 can be freed from deposits at regular intervals during the operation of the exhaust gas treatment device 11 by applying a short and powerful current pulse to the electric insulator 14, leading to heating and ultimately to burn off of the soot particles. It is also possible for a number of such current pulses to be triggered. It is possible, for example, to trigger such a sequence of current pulses regularly before starting or when starting to put an exhaust gas treatment device according to the invention into operation.

A current pulse of this kind can be triggered by a short voltage peak, which is applied across the insulator 14 and/or between the first honeycomb body 12 and the second honeycomb body 13. Such a voltage peak can be significantly above the normal operating voltage, that is to say, for example, significantly above 30 kV [30 kilovolts=30,000 volts] and, in particular, significantly above 50 kV [50 kilovolts=50,000 volts]. At such high voltages, electrical conductivity is produced in the deposited soot on the electric insulator, leading to the formation of a current pulse. It is important that the voltage peak or the current pulse should be very short in duration, ensuring that only deposits of soot particles are burnt off, while the insulator 14 is not damaged.

Figure 3:
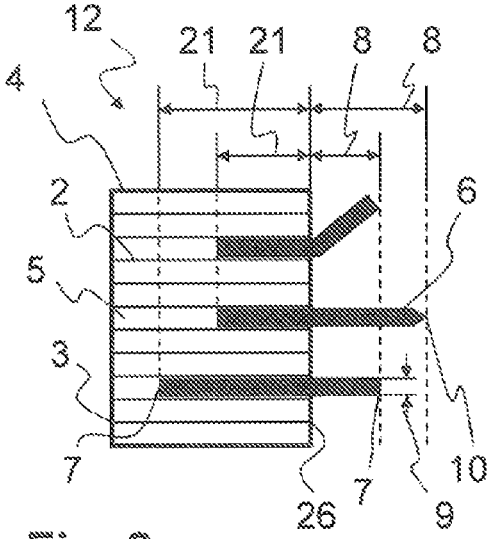
FIG. 3 is a longitudinal-sectional view of another embodiment of a first honeycomb body.
Figure 4:
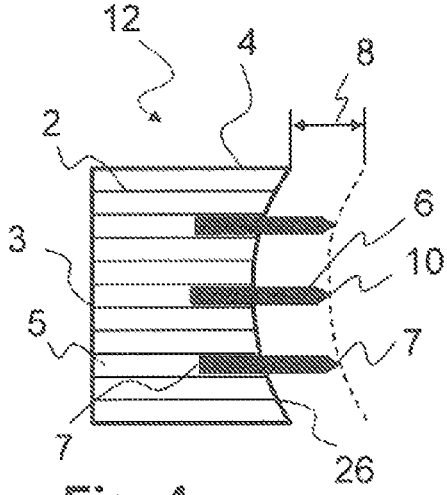
FIG. 4 is a longitudinal-sectional view of an additional embodiment of a first honeycomb body.

FIG. 3 and FIG. 4 show further embodiments or details of first honeycomb bodies 12 of an exhaust gas treatment device. These first honeycomb bodies 12 also have metal foils 2 which define channels 5 extending from a first front side 3 toward a first rear side 26. Each of the honeycomb bodies 12 also has a circumferential surface 4, which surrounds the first honeycomb bodies 12 between the first front side 3 and the first rear side 26. The multiplicity of electrodes 6 is in each case inserted into the channels 5 in the first honeycomb body 12 and projects beyond the first rear side 26 over a first length 8.

According to the embodiment of FIG. 3, the first length 8 of some of the electrodes 6 can differ (only three electrodes are illustrated therein for the sake of clarity) and all of them are shown as differing (in orientation, shape, length, etc.), but this is not necessary. In the embodiment shown in FIG. 4, the first length 8 of the electrodes 6 is the same. In FIG. 4, however, the first rear side 26 is given a concave shape. The inner ends 7 of the electrodes 6 also form a concave shape in this case. It is possible, for example, for a second honeycomb body to be disposed opposite a first honeycomb body 12 in accordance with FIG. 4, with that second honeycomb body having a correspondingly convex shape, as a result of which the intermediate space between the first honeycomb body 12 and the second honeycomb body is curved. It is likewise possible for the first honeycomb body 12 to be convex and for the second honeycomb body to be of correspondingly concave construction. It is also possible for the second distance between the first honeycomb body 12 and the second honeycomb body 13 in the region of the intermediate space to vary and/or for the first distance between the electrodes 6 and the second honeycomb body 13 to vary. In this way, it is possible to achieve a desired formation of the electric field and/or plasma in particular areas of the intermediate space and, at the same time, to achieve a selective influence on the flow distribution of the exhaust gas across the honeycomb bodies.

The electrodes can have various constructions. In FIG. 3, three different embodiments of the ends 7 of the electrodes 6 are illustrated. The uppermost electrode 6 has a bend or kink. The central electrode 6 has a tip 10 which tapers conically. As an alternative, it is also possible for an electrode 6 to have a tip shaped in the manner of a screwdriver, ending in the form of a flattened line or edge. The lowermost electrode 6 is embodied with a straight, flat or, alternatively, blunt end 7. In additional embodiments, which are not shown herein, it is also possible for the electrodes 6 to have ends 7 with a serrated construction with a number of points or rounded ends 7. The electrodes 6 each have a diameter 9, and it is possible for the electrodes to be embodied differently in this respect.

Figure 5:
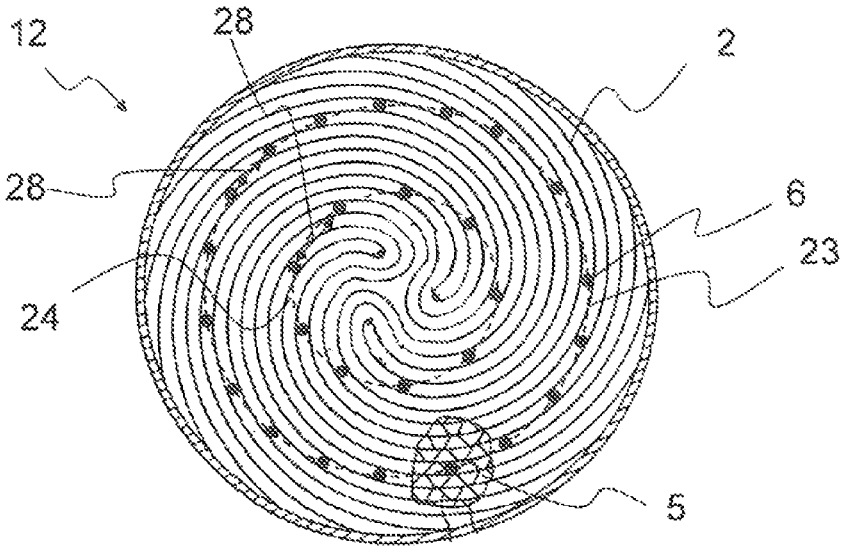
FIG. 5 is an end-elevational view of a first honeycomb body.

FIG. 5 is an end view of the first rear side 26 of a first honeycomb body 12. Respective electrodes 6 are inserted into individual channels 5 in this first honeycomb body 12. The first honeycomb body 12 is constructed from a plurality of stacks including smooth and structured metal foils 2, which are coiled in such a way that all of the metal foils rest with their opposite edges against the housing of the honeycomb body and are brazed or welded there. It is possible for the first honeycomb body 12 to have a first radial zone 23 and a second radial zone 24 and for the density of the electrodes 6 to differ in the first radial zone 23 from the density of the electrodes in the second radial zone 24. It is also possible for the first length and/or the shape of the ends or tips of the electrodes 6 to be made different in a first radial zone 23 and a second radial zone 24. In particular, a distances 28 between the electrodes 6 in the first radial zone 23 and in the second radial zone 24 can differ. It is likewise possible to provide different power supplies for the zones, thus enabling independent operation of the electrodes to be carried out in the zones. Variation of the electric field over the cross section of the honeycomb bodies is possible through the use of these measures.

Figure 6:
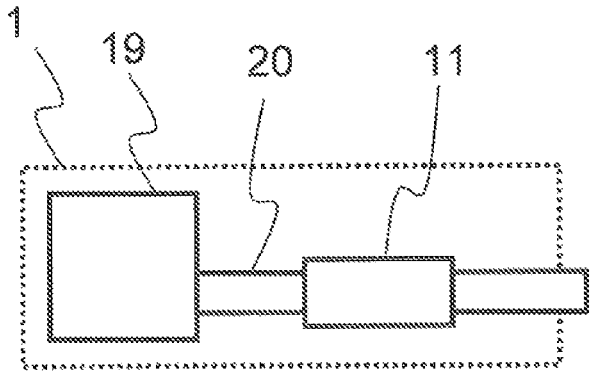
FIG. 6 is a plan view of a motor vehicle having an exhaust gas treatment device according to the invention.

FIG. 6 diagrammatically shows a motor vehicle 1 having an internal combustion engine 19 and an exhaust line 20, in which an exhaust gas treatment device 11 according to the invention is provided on the exhaust line 20.

The invention provides an exhaust gas treatment device which is very compact and is therefore suitable for use in motor vehicle construction. It furthermore allows accurate setting of the electric field for bringing about efficient cleaning of the exhaust gases. In particular, the problems stated at the outset are thereby overcome.

The invention claimed is:

1. An exhaust gas treatment device, comprising:

a first at least partially electrically conductive honeycomb body having a first front side and a first rear side;

a second at least partially electrically conductive honeycomb body having a second front side and a second rear side;

said first honeycomb body and said second honeycomb body defining an intermediate space therebetween;

a multiplicity of electrodes fastened to said first honeycomb body, extending beyond said first rear side by a first length into said intermediate space and positioned at a first distance from said second front side of said second honeycomb body, wherein said first distance is sized and said electrodes are disposed at a spacing relative to one another for generating an accurately defined electric field and/or plasma in said intermediate space; and a power supply configured to form an electric potential between said electrodes and said second honeycomb body.

2. The exhaust gas treatment device according to claim 1, wherein said first length of at least one of said multiplicity of electrodes is different than said first length of at least one other of said multiplicity of electrodes.

3. The exhaust gas treatment device according to claim 1, wherein at least said first rear side of said first honeycomb body or at least said second front side of said second honeycomb body has a non-planar shape.

4. The exhaust gas treatment device according to claim 1, wherein said first distance is between 5 mm and 50 mm.

5. The exhaust gas treatment device according to claim 1, which further comprises an insulator surrounding said intermediate space.

6. The exhaust gas treatment device according to claim 1, wherein said power supply is configured to generate an electric voltage of more than 5 kV between said electrodes and said second honeycomb body.

7. The exhaust gas treatment device according to claim 1, wherein said first honeycomb body has at least one at least partially structured metal foil, and said second honeycomb body has at least one filter material.

8. A motor vehicle, comprising:

an internal combustion engine; and an exhaust gas treatment device according to claim 1 connected to said internal combustion engine for treating exhaust gases from said internal combustion engine.

9. A method for treating exhaust gas containing soot particles, the method comprising the following steps:

providing an exhaust gas treatment device according to claim 1; and at least temporarily applying an electric field between the electrodes and the second honeycomb body, causing at least some of the soot particles flowing through the exhaust gas treatment device to be at least ionized or agglomerated and deposited on the second honeycomb body.

10. The method according to claim 9, which further comprises operating a first set of the electrodes differently than a second set of the electrodes.

11. An exhaust gas treatment device, comprising:

a first at least partially electrically conductive honeycomb body having a first front side and a first rear side;

a second at least partially electrically conductive honeycomb body having a second front side and a second rear side;

said first honeycomb body and said second honeycomb body defining an intermediate space therebetween;

a multiplicity of electrodes fastened to said first honeycomb body, extending beyond said first rear side by a first length into said intermediate space and positioned at a first distance from said second front side of said second honeycomb body, said first distance being between 5 mm and 50 mm and said first length being between 2 mm and 20 mm; and a power supply configured to form an electric potential between said electrodes and said second honeycomb body.

12. An exhaust gas treatment device, comprising:

a first at least partially electrically conductive honeycomb body having a first front side and a first rear side;

a second at least partially electrically conductive honeycomb body having a second front side and a second rear side;

said first honeycomb body and said second honeycomb body defining an intermediate space therebetween;

a power supply configured to form an electric potential; and a multiplicity of electrodes fastened to said first honeycomb body, extending beyond said first rear side by a first length into said intermediate space and positioned at a first distance from said second front side of said second honeycomb body, wherein said first length and said first distance are sized so that the electric potential is formed only between said electrodes and said second honeycomb body.

* * * * *